US006179450B1

(12) United States Patent
Waldmann

(10) Patent No.: US 6,179,450 B1
(45) Date of Patent: Jan. 30, 2001

(54) HALOGEN LAMP WITH LIGHT EXIT SHIELD

(75) Inventor: Gerhard Waldmann, Dauchingen (DE)

(73) Assignee: Herbert Waldmarin GmbH & Co. (DE)

( * ) Notice: Under 35 U.S.C. 154(b), the term of this patent shall be extended for 0 days.

(21) Appl. No.: 09/240,411

(22) Filed: Jan. 29, 1999

(30) Foreign Application Priority Data

Jan. 31, 1998 (DE) ..... 198 03 880

(51) Int. Cl.[7] ..... F21V 15/00

(52) U.S. Cl. ..... 362/376; 362/263; 362/290; 362/354

(58) Field of Search ..... 362/376, 263, 362/354, 455, 290, 331

(56) References Cited

U.S. PATENT DOCUMENTS

| | | | | |
|---|---|---|---|---|
| 1,343,899 | * | 6/1920 | Best | 362/376 |
| 1,619,720 | * | 3/1927 | Gordon | 362/376 |
| 1,712,351 | * | 5/1929 | Mara | 362/354 |
| 2,119,370 | * | 5/1938 | Van Leunen | 362/290 |
| 5,349,510 | | 9/1994 | Jordan et al. | 362/374 |

FOREIGN PATENT DOCUMENTS

| | | |
|---|---|---|
| 680 684 | 8/1990 | (CH) . |
| 4202295 C1 | 1/1992 | (DE) . |
| 4204669A1 | 2/1992 | (DE) . |
| 4210439A1 | 3/1992 | (DE) . |

* cited by examiner

*Primary Examiner*—Sandra O'Shea
*Assistant Examiner*—Peggy A Neils
(74) *Attorney, Agent, or Firm*—Eugene E. Renz, Jr., PC

(57) ABSTRACT

A halogen lamp assembly comprising a housing, a halogen bulb installed in the housing, and a light exit shield removably mounted in the light exit opening of the housing, a support ring with a radially inward-projecting ring land, a first ring-shaped groove on inside radial surface of said support ring, a first O-ring mounted in said groove, said ring land being in front of the forward of the first O-ring, a first shield disk resting against the rear surface of the ring land, and a shield grid removably mounted in the support ring.

7 Claims, 3 Drawing Sheets

HALOGEN LAMP WITH LIGHT EXIT SHIELD

BACKGROUND OF THE INVENTION

The lamps which have a removable light exit shield with a permanently installed shield disk, that is, a clear or matte disk of glass, plastic, or the like, at the light exit opening of its housing, are known. Light exit shields with permanently installed shield grids are also known.

SUMMARY OF THE INVENTION

According to the invention, therefore, a lamp which can be provided with any desired type of light source and which has a flip-up light exit shield with a permanently installed lens or shield disk and a second permanently installed shield disk is known from U.S. Pat. No. 5,349,510. No provisions are made for the possible removal of the lens and/or the shield disks, and any attempt at such removal would be associated with considerable effort.

A halogen lamp in which two shield disks and a shield grid are laid loosely between two retaining rings in the light exit opening of the housing is known from CH680,684. The front or outer retaining ring can be removed from the housing, whereupon the shield disks and the shield grid are freed and can fall out of the light exit opening.

The goal of the present invention is to provide a halogen lamp in which it is possible to install, in removable fashion, one or two of the same or different shield disks and a shield grid in a light exit shield which can be removed from the lamp housing. It is also to be possible to handle the light exit shield as a closed functional unit, regardless of the number of parts which have been inserted into it.

This task is accomplished in accordance with the invention in a halogen lamp of the type comprising a housing, a halogen bulb installed in the housing, and a light exit shield removably mounted in the light exit opening of the housing. The lamp includes a support ring with a radially inward-projecting ring land, a first ring-shaped groove on inside radial surface of said support ring, a first O-ring mounted in said groove, ring land being in front of the forward of the first O-ring. A first shield disk rests against the rear surface of the ring land, and a shield grid is removably mounted in the support ring.

The light exit shield designed according to the invention can therefore be handled as a closed functional unit comprising any desired set of shield disks and/or shield grids and can be removed with all of its parts held loosely in it from the housing and possibly reinstalled after certain of the individual parts have been replaced.

The first O-ring or, in the case of the embodiment, having two O-rings are held in their grooves regardless of whether or not they are resting against shield disks. As desired, one or two shield disks can be inserted at the locations provided for them in front of the first O-ring or between the two O-rings. The shield grid, which is also removable, is held in any desired manner, i.e., either in a positive form-locking or in a friction-locking manner, at the inner end of the support ring.

There are other features of the present invention including a spacer ring, which serves, first, to provide support against the halogen bulb mounted in the housing and second to support the loose retaining ring of the shield grid. The specific designs such as the lead or bayonet arrangement to hold the spacer ring or the retaining ring itself on the housing are also meritorious advanced of the present invention.

BRIEF DESCRIPTION OF THE DRAWINGS

These and other objects of the present invention and various features and details of the operation and construction thereof are hereinafter more fully set forth with reference to the accompanying drawings, wherein.

DESCRIPTION OF THE METHOD AND SYSTEM

Figure 1:
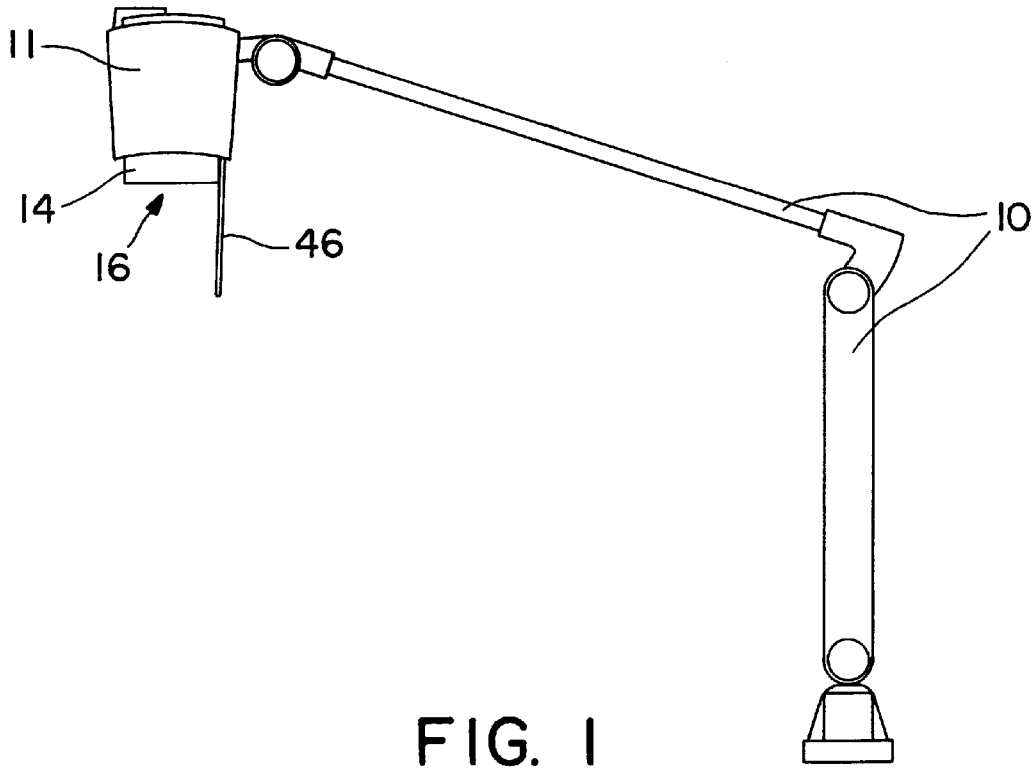
FIG. 1 shows a side view of the overall halogen lamp.
Figure 2:
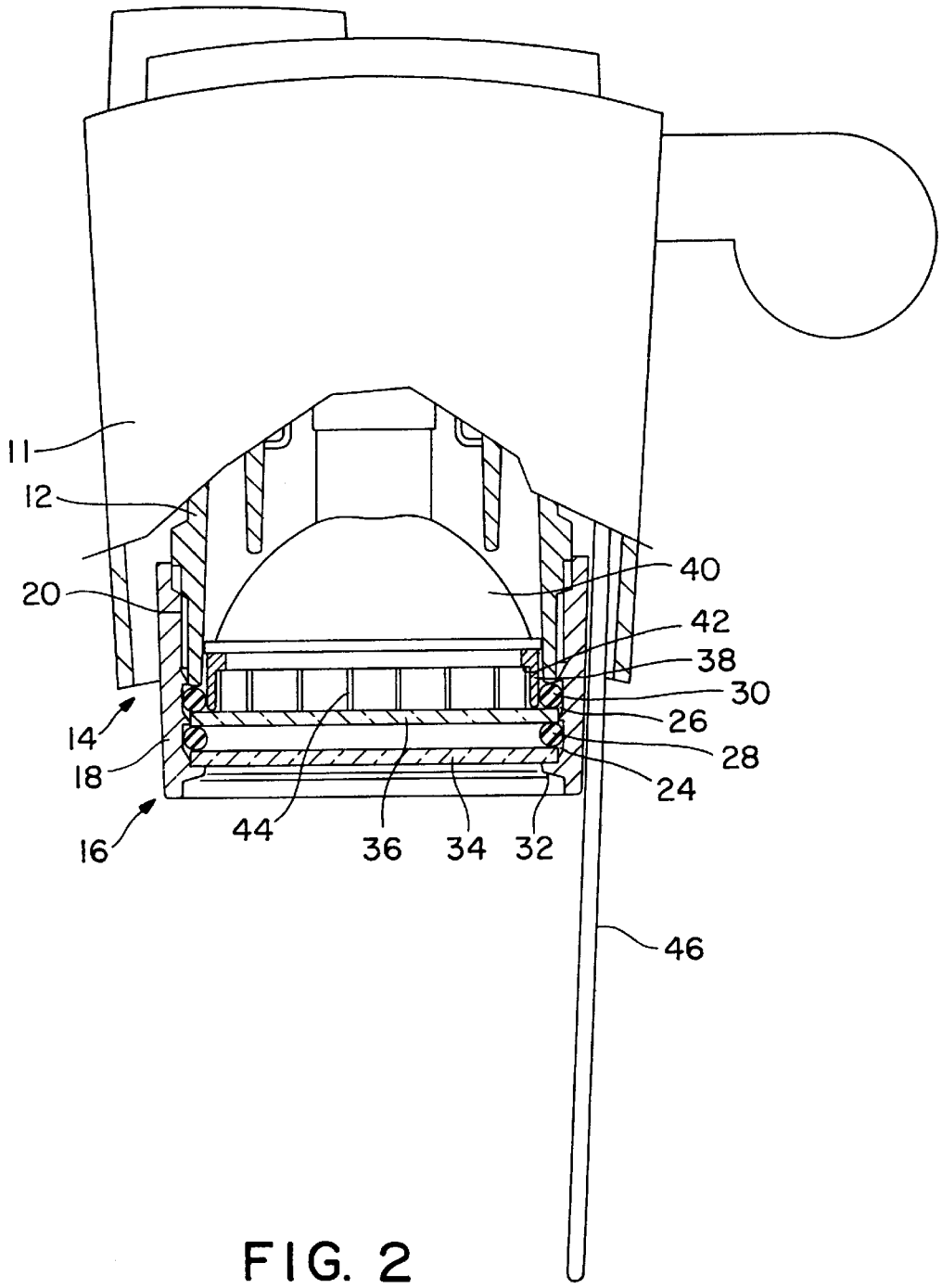
FIG. 2 shows an enlarged and partially cut-away side view of the lamp housing.
Figure 3:
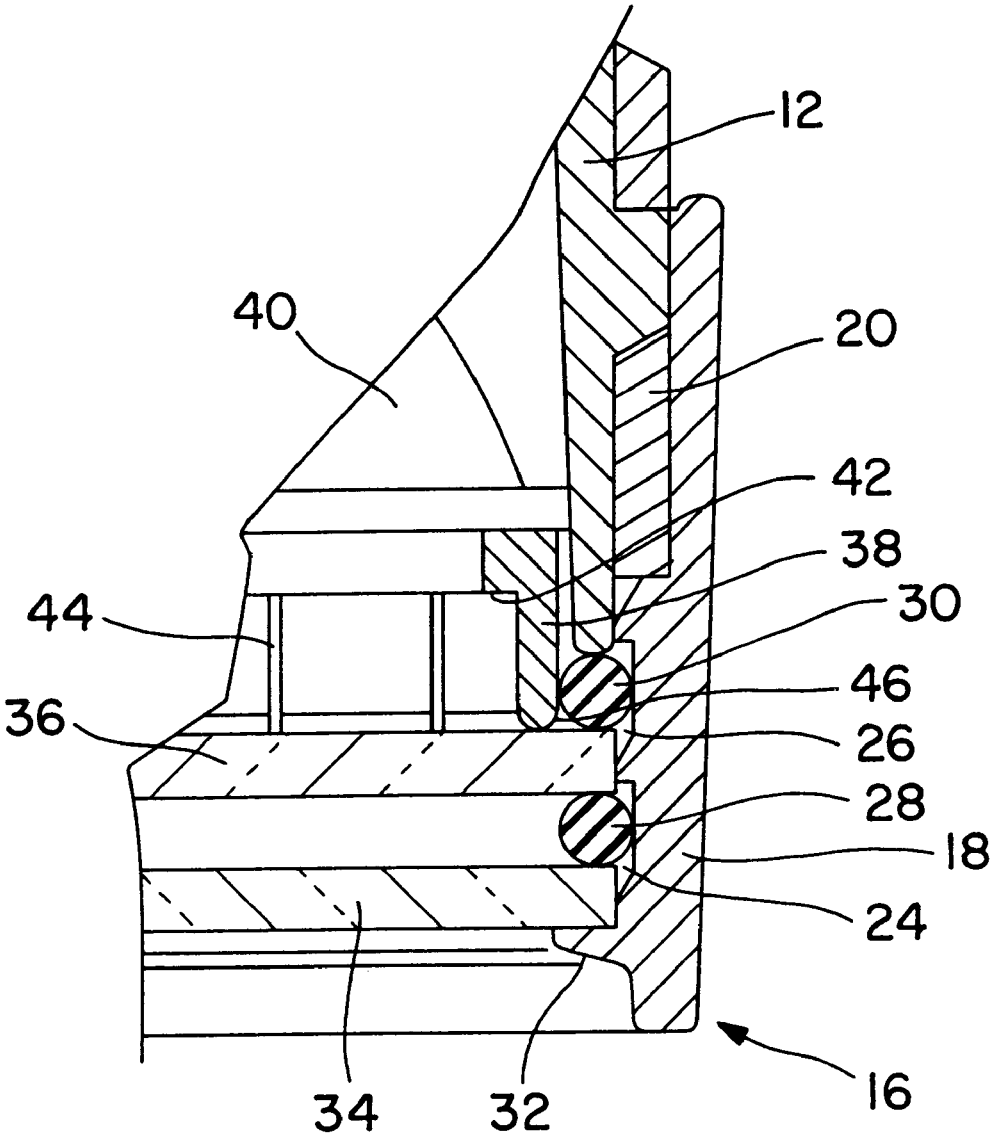
FIG. 3 shows a partial cross section, enlarged again with respect to FIG. 2.

Referring now to the drawings and particularly to FIG. 1, there is shown a halogen lamp assembly in accordance with the present invention. The lamp includes a linkage of rods 10 and an external housing 11, supported adjustably on said linkage of rods 10. A light exit shield, designated overall by reference number 16, is installed in light exit opening 14, which is located at the forward end of external housing 11. Light exit shield 16 has a support ring 18, which is screwed by thread 20 onto the forward end of the actual housing 12, which is installed inside external housing 11.

A first ring-shaped groove 24 and a second ring-shaped groove 26 are provided on the inside surface of the forward end of support ring 18, i.e., the end facing away from halogen bulb 40. A first elastic O-ring 28 and a second elastic O-ring 30 are inserted into these grooves. Near the forward end of support ring 18, a ring land 32 projects inward from the inside surface of the ring. The rear surface of this land rests against a first shield disk 34. The rear surface of first shield disk 34 is held by first O-ring 28, whereas a second shield disk 36, which is parallel to first shield disk 34, rests against the rear surface of first O-ring 28. The second disk is held in turn at its rear surface by second O-ring 30. The forward edge of a spacer ring 38, the rear-facing edge of which is supported against halogen bulb 40 mounted in housing 12, is also in contact with the rear surface of second shield disk 36.

A shield grid 44 fills the space between a forward-facing, ring-shaped shoulder 42 on the inside surface of spacer ring 38 and the rear surface of second shield disk 36. The forward edge of spacer ring 38 is provided with an outward-directed bead 46, which grips second O-ring 30 slightly from underneath and thus ensures that spacer ring 38 is held firmly in light exit shield 16, consisting of support ring 18, shield disks 34, 36, spacer ring 38, and shield grid 44. Light exit shield 16 can therefore be handled as a single functional unit and can be removed as a complete subassembly from, and set back into position on, housing 12. In the removed state, spacer ring 38, shield grid 44, and one or both shield disks 34, 36 can be easily removed or replaced as desired, whereupon light exit shield 16 can be placed back on the housing. Thus, any desired modification can be made to light exit shield 16, or individual parts can be replaced by others with a different function or a different shape. The long extension 46 is a handle for adjusting the external housing 11 of the halogen lamp assembly.

Even though particular embodiments of the present invention have been illustrated and described herein, it is not intended to limit the invention and changes and modifications may be made therein within the scope of the following claims.

What is claimed is:

1. In a halogen lamp assembly having a housing (10), a halogen bulb (40) and installed in the housing, a unitary light exit shield assembly (16) removably mounted in the light exit opening (14) of the housing (10) comprising:

a support ring (18) with a radially inwardly-projecting ring land (32), a first ring-shaped groove (24) on the inside radial surface of said support ring (18), a first O-ring (28) mounted in said groove (24), said ring land (32) being in front of the forward of the first O-ring (28), a first shield disk (34) resting against the rear surface of the ring land (32), and a shield grid (44) removably mounted in the support ring (18) and a second shield disk (36) inserted between the shield grid (44) and the first shield disk (34), the front surface of said second disk resting on the first O-ring (28), and the rear surface therefor resting against a second O-ring (30) located in a second ring-shaped groove (26) whereby the light exit shield may be handled as a single functional unit and can be removed from and reassembled in the housing as a complete subassembly.

2. In a halogen lamp assembly having a housing (10), a halogen bulb (40) and installed in the housing, a unitary light exit shield assembly (16) removably mounted in the light exit opening (14) of the housing (10) comprising, a support ring (18) with a radially inwardly-projecting ring land (32), a first ring-shaped groove (24) on the inside radial surface of said support ring (18), a first O-ring (28) mounted in said groove (24), said ring land (32) being in front of the forward of the first O-ring (28), a first shield disk (34) resting against the rear surface of the ring land (32), and a shield grid (44) removably mounted in the support ring (18) and a second shield disk (36) inserted between the shield grid (44) and the first shield disk (34), the front surface of said second disk resting on the first O-ring (28), and the rear surface therefor resting against a second O-ring (30) located in a second ring-shaped groove (26) whereby the light exit shield may be handled as a single functional unit and can be removed from and reassembled in the housing as a complete subassembly.

3. A halogen lamp assembly according to claim 1 characterized in that the forward edge of a spacer ring (38) rests against the rear surface of the second shield disk (36) whereby after the support ring (18) has been removed from the housing (12), the spacer ring is held against the second O-ring (30); and wherein the spacer ring is supported by its rear edge against the halogen bulb (40) when the support ring (18) is attached to the housing (12).

4. A halogen lamp assembly according to claim 3, characterized in that the spacer ring (38) is held against the second O-ring (30) by a bead (46), which engages with the second O-ring (30).

5. A halogen lamp assembly according to claim 3, characterized in that the shield grid (44) fills the area between the rear surface of the second shield disk (36) and a shoulder (42) on the spacer ring (38).

6. A halogen lamp assembly according to claim 1, characterized in that the support (18) can be attached to the housing (12) by means of a thread (20).

7. A halogen lamp assembly according to claim 1, characterized in that the support (18) can be attached to the housing (12) by means of a bayonet joint.

* * * * *

UNITED STATES PATENT AND TRADEMARK OFFICE

CERTIFICATE OF CORRECTION

PATENT NO. : 6,179,450 B1
DATED : January 30, 2001
INVENTOR(S) : Waldmann

It is certified that error appears in the above-identified patent and that said Letters Patent is hereby corrected as shown below:

Title page,
Item [73], Assignee, should read -- Herbert Waldmann GmbH & Co. --

Signed and Sealed this

Fifth Day of October, 2004

JON W. DUDAS
*Director of the United States Patent and Trademark Office*